United States Patent [19]

Pomfret et al.

[11] 4,338,893

[45] Jul. 13, 1982

[54] DECOMPRESSION DEVICE

[75] Inventors: Colin T. Pomfret; Fritz Freyn, both of Graz, Austria

[73] Assignee: Hans List, Graz, Austria

[21] Appl. No.: 136,669

[22] Filed: Apr. 2, 1980

[30] Foreign Application Priority Data

Apr. 19, 1979 [AT] Austria ..... 2971/79

[51] Int. Cl.[3] ..... F01L 13/08

[52] U.S. Cl. ..... 123/90.16; 123/182; 123/316

[58] Field of Search ..... 123/316, 90.16, 182

[56] References Cited

U.S. PATENT DOCUMENTS

| | | | |
|---|---|---|---|
| 2,850,002 | 9/1958 | Hovel | 123/182 |
| 3,057,336 | 10/1962 | Hatz | 123/316 |
| 3,496,922 | 2/1970 | Campen | 123/182 |
| 3,901,199 | 8/1975 | Smith | 123/182 |
| 4,184,468 | 1/1980 | Freyn | 123/182 |

FOREIGN PATENT DOCUMENTS 281506 5/1970 Austria .

*Primary Examiner*—Craig R. Feinberg
*Assistant Examiner*—W. R. Wolfe
*Attorney, Agent, or Firm*—Watson, Cole, Grindle & Watson

[57] ABSTRACT

A decompression device for an internal combustion engine having a camshaft (4) with at least one cam (21) having a base circle (20) and a lobe elevated therefrom, a valve acting at a combustion chamber, and a transmitting member, e.g., a push rod (12), transmitting the lift of the cam (21) to the valve, has a control shaft (5), a decompression cam (11) and a ratched wheel (8) connected to the control shaft (5), and a shifting member (14) interworking with the ratched wheel (8) for resetting the decompression cam (11). The decompression cam (11) is arranged between the transmitting member and a cam-free part of the camshaft (4) and the shifting member (14) is arranged eccentrically at the camshaft (4) at a distance to the axis of the camshaft (4) which is greater than half the root diameter thereof.

By this arrangement it is possible to lift the transmitting member, e.g., the push rod from the base circle of the cam of the camshaft without further supplementary means, simply by turning the decompression cam.

12 Claims, 5 Drawing Figures

DECOMPRESSION DEVICE

BACKGROUND OF THE INVENTION

The present invention relates to a decompression device comprising a control shaft, an internal combustion engine which has a camshaft with at least one cam having a base circle and a lobe elevated therefrom, a valve acting in association with a combustion chamber, and a transmitting member, e.g., a push rod, transmitting the lift of the cam to the valve, and more particularly to a decompression device used in such an engine, the decompression cam and a ratchet wheel connected to the control shaft, and a shifting member interacting with the ratchet wheel for resetting the decompression cam.

DESCRIPTION OF THE PRIOR ART

A decompression device of the aforementioned type for an internal combustion engine is known, e.g., from Austrian Patent No. 281,506. This known device acts on an intermediate lever which transmits the lift of the cam to the push rod and enables the lifting of the push rod via the lifting of an arm of the intermediate lever pinjointed at the push rod by turning the control shaft, which is rigidly connected to the decompression cam. Further, a valve of the engine is lifted via a rocker arm by the push rod, enabling the decompression of the combustion chamber. The reset of the decompression cam of this known arrangement is done automatically by a ratchet wheel interacting with a shift dog arranged on the intermediate lever. The ratchet wheel is turned with each upward movement of the shift dog by an angle according to the pitch until the decompression cam connected to the ratchet wheel has again reached the position where it no longer limits the lift of the push rod or the valve, respectively. This position of the decompression cam is in comformity with a missing tooth on the ratchet wheel, whereby the shift dog interacting with the ratchet wheel comes out of mesh and the reset of the decompression cam is finished. It is thus assured that the decompression action initiated by the turning of the control shaft will be automatically discontinued after a number of rotations of the camshaft defined by the number on teeth of the ratchet wheel.

It is difficult to use a decompression device of this known kind in an internal combustion engine with push rods which are operated without intermediate levers directly by the camshaft because it is rather complicated to utilize the up and down movement of the push rods for the operation of the automatic reset of the decompression device. The known such arrangements have been very complicated and multipartite, and their operating reliability has not been good.

It is an object of the present invention to provide a decompression device for an internal combustion engine of the above-mentioned kind which is of only a few parts and which will always function in a reliable fashion.

SUMMARY OF THE INVENTION

According to the present invention the decompression cam is arranged between the transmitting member and a cam-free part of the camshaft, and the shifting member is arranged eccentrically to the camshaft at a distance from the axis of the camshaft which is greater than half the root diameter thereof. By this arrangement of the decompression cam between the transmitting member and a cam-free part of the camshaft, it is possible to lift the transmitting member, e.g., the push rod, from the base circle of the cam of the camshaft without further supplementary means simply by turning the decompression cam. This twisting of the decompression cam is done via the control shaft and causes also a twisting of the ratchet wheel rigidly connected to the control shaft. The shifting member, which was formerly idling because of the tooth space on the ratchet wheel, will engage with the teeth on the ratchet wheel and cause the decompression cam to rotate with every further rotation of the camshaft by an angle according to the tooth pitch of the ratchet wheel until the tooth space and the idling of the shifting member enables by it stops the resetting of the decompression cam, so as to terminate the decompression action.

According to a further embodiment of this invention the shifting member includes a spring loaded pin which is arranged in a bore in a shoulder of the camshaft. Thereby it is easy to bring the decompression cam in gear by twisting the control shaft, as the spring-loaded pin can be moved easily in an axial direction by the back of the tooth of the ratchet wheel, which acts as an inclined plane.

According to another embodiment the decompression cam is supported by the cam-free part of the camshaft during the decompression action. Thereby, the decompression cam, which in certain cases can have a relatively small root diameter and is loaded at least during a part of the decompression action by the full force of the valve spring, cannot unduly bend.

It is further advantageous if, according to another embodiment of this invention, the cam-free part of the camshaft has a smaller diameter than the root diameter of the camshaft, because thereby the root diameter of the decompression cam can be enlarged and the cam can be made even more stable.

According to a further development of the present invention the decompression cam has a constriction in the region supported by the camshaft during the decompression action, which is in conformity with the surface of the camshaft in this region. The otherwise spot shaped place of contact between the camshaft of the engine and the decompression cam is thereby enlarged to a line and the wear of the camshaft and the decompression cam is reduced.

According to a still further feature of this invention the control shaft carrying the decompression cam is pivoted in an eccentric bearing sleeve. The clearance between the decompression cam and the camshaft can be adjusted easily by twisting this eccentric bearing sleeve, so that on the one side very little bending of the decompression cam is possible under the load of the valve spring and on the other side these two parts are without contact during the normal operation of the engine.

In a still further development of the invention the device additionally comprises a locking device to lock the positioning of the control shaft at point where the decompression cam is not in operation. Preferably, the locking device is formed of a spring-loaded ball and a cavity into which the ball can snap. Thereby, the operating reliability is increased and a simple handling of the decompression device is made easy.

DESCRIPTION OF THE DRAWINGS

The present invention is hereinafter more specifically described with reference to an exemplary embodiment depicted in the drawings, wherein.

DESCRIPTION OF THE PREFERRED EMBODIMENT

Figure 1:
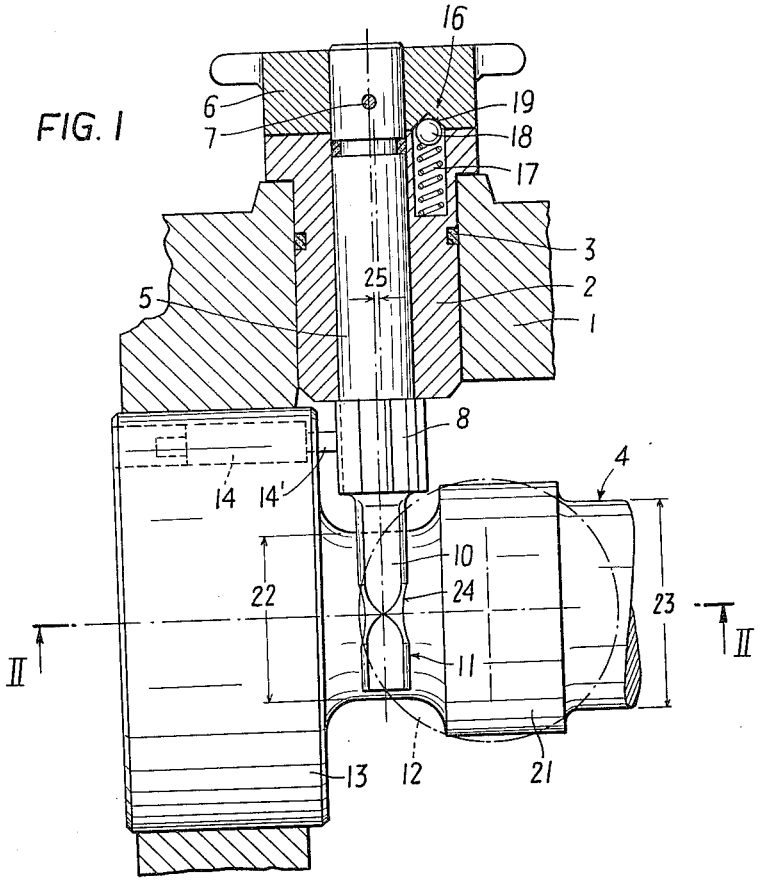
FIG. 1 is a horizontal cross sectional view of the decompression device according to the invention.
Figure 2:
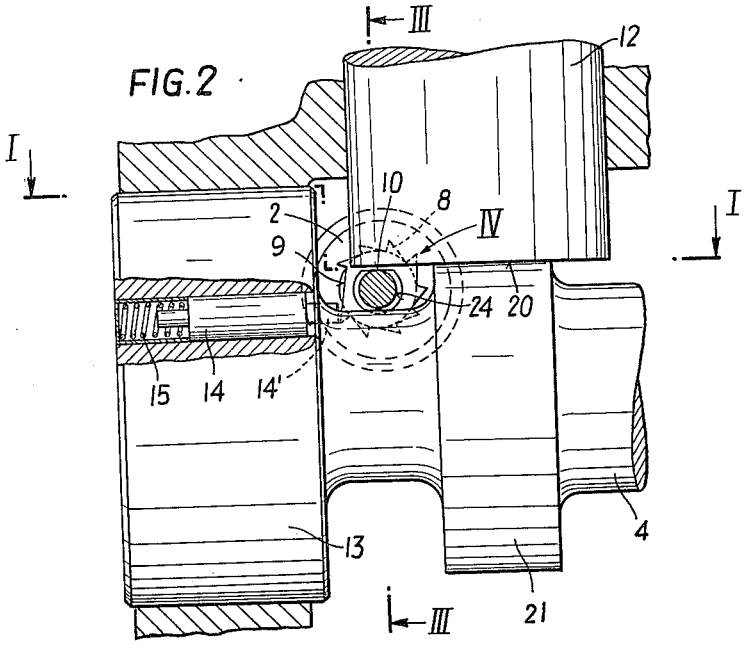
FIG. 2 is a vertical cross sectional view taken along line II—II in FIG. 1.

FIG. 1 shows a bearing sleeve 2 inserted in a bore in a side wall 1 of the crankcase of an internal combustion engine (not shown), which is sealed by means of a sealing member 3. A control shaft 5 lying oblique to a camshaft 4 is pivoted in the bearing sleeve 2 and mounts at its outer end a handle 6 fixed by a split pin 7. At the other side, the control shaft 5 mounts a wheel ratchet 8 which has a toothing, except for circumferential portion 9 where a tooth is omitted (FIG. 2,4). The inner, cylindrical end of the control shaft 5 has a flattened portion 10 and forms a decompression cam 11, which interacts with a push rod 12 of the valve drive (not shown).

Figure 3:
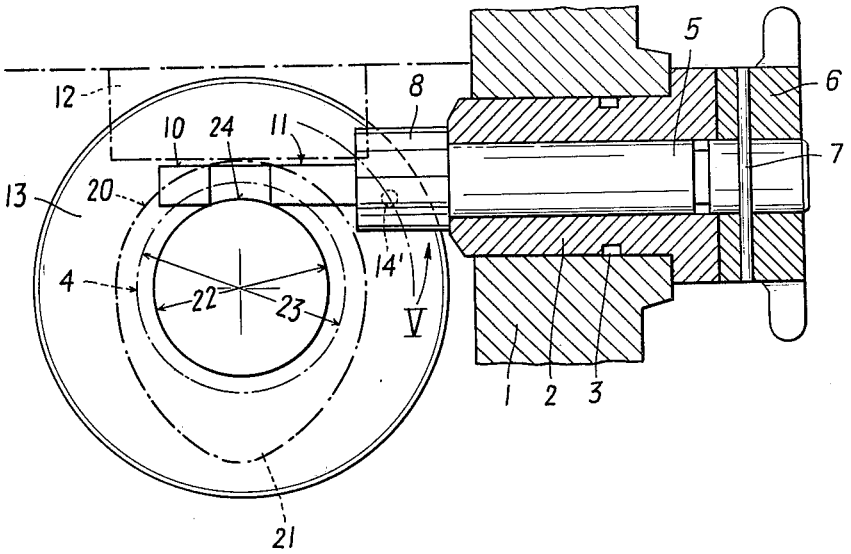
FIG. 3 is a cross sectional view taken along line III—III in FIG. 2.

A pin 14, which acts as a shifting member, is arranged in a bore in a shoulder 13 of the camshaft 4, and is loaded by a spring 15. The pin 14 includes a tenon 14' which projects beyond the shoulder 13 so that the pin 14 can interact with the teeth on the ratchet wheel 8 in the way shown on an enlarged scale in FIG. 4 and described below. In the position in which the decompression cam 11 is not in operation, the handle 6 connected to the control shaft 5 is fixed by a locking device 16, which comprises a ball 18 loaded by a spring 17, the spring-loaded ball 18 snap fitting into a cavity 19 in the handle 6. To start the decompression action, the handle 6 is twisted by an angle depending upon the flattened portion 10 of the decompression cam 11 (in the depicted embodiment by about 45 degrees) in the direction permitted by the ratchet wheel 8. In this way the decompression cam 11 comes into gear and lifts the push rod 12 in a fashion dependent upon the flattened portion 10 sufficient to lift the push rod 12 from a base circle 20 of a cam 21 of the camshaft 4 (FIG. 3). Therefore, the valve actuated by the push rod 12 cannot close completely and the full compression in the cylinder of the engine is prevented.

Figure 5:
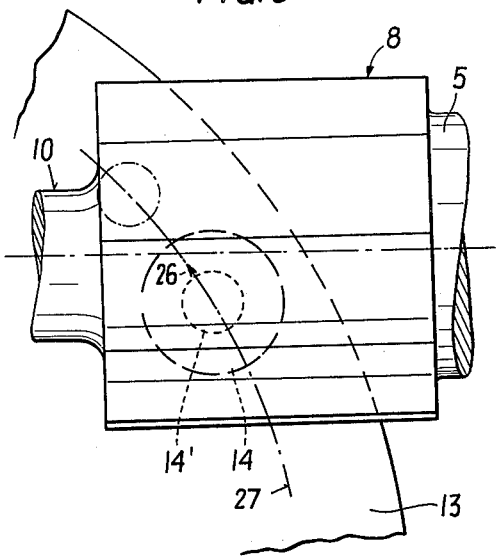
FIG. 5 shows the detail V of FIG. 3 on an enlarged scale.
Figure 4:
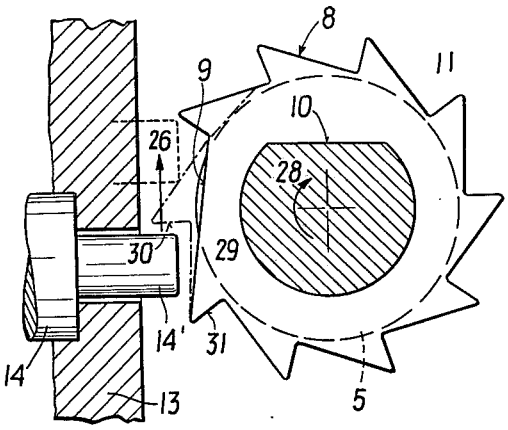
FIG. 4 shows the detail IV of FIG. 2 on enlarged scale.

Simultaneously with the twisting of the decompression cam 11, the ratchet wheel 8 is twisted by the same angle. The idling of the tenon 14', which was possible before because it was located adjacent portion 9 of the circumference of the ratchet wheel 8 as it is rotated therepast, now comes into gear insofar as it engages with the teeth of the ratchet wheel 8 with every rotation of the camshaft 4 (FIG. 3, 4, 5). The continuously traced part of FIG. 4 shows the position of the ratchet wheel 8 when the idling of the tenon 14', which rotates in the direction of arrow 26 along the line 27 (FIG. 5) about the axis of the camshaft 4, is possible. By the described twisting of the control shaft with the ratchet wheel by about 45 degrees in the direction of arrow 28, the ratchet wheel 8 reaches a position as shown by the dash-dotted line in FIG. 4. The tenon 14' of the spring loaded pin 14 can retract easily into the bore of the shoulder 13 of the camshaft if pushed by the back flank 29 of the first tooth, which acts as an inclined plane. By moving in the direction indicated by arrow 26, the tenon 14' meshes with the front flank 30 and, therefore, turns the ratchet wheel 8 and the decompression cam 11 until the tenon again loses contact with the ratchet wheel in the dash-lined position. Because of the moving up of the next front flank 31, the partial turning of the ratchet wheel is repeated during the next rotation of the tenon 14' arranged on the camshaft 4. Thereby, the ratchet wheel 8 and the decompression cam 11 are reset at each rotation of the camshaft 4 by an angle according to the pitch of the teeth of the ratchet wheel 8 until the portion 9, which corresponds to the position of the control shaft 5 at which the decompression cam 11 is not in operation, is reached and the idling of the tenon 14' again occurs. According to this, the push rod 12 is lowered again to the base circle 20 of the cam 21 after a number of rotations according to the number of teeth on the ratchet wheel 8, and the complete closing of the valve actuated by the push rod 12 is enabled again.

From FIG. 1 it can be seen that in the depicted embodiment, the diameter 22 of the cam-free part of the camshaft 4, by which the decompression cam 11 is supported during the decompression action, is smaller than the root diameter 23 of the camshaft 4. Further, the decompression cam 11 shows a constriction 24 in the supported region, which is in conformity with the surface of the camshaft 4 in this region.

The control shaft 5 is pivoted eccentrically in the bearing sleeve 2, with an eccentricity 25 which is small compared to the diameter of the shaft. It is thus possible to adjust the position of the decompression cam 11 with regard to the push rod 12 and the diameter 22 of the camshaft 4 in such a way that on the one side the bending of the decompression cam 11, which is at least during a part of the decompression action loaded by the full force of the valve spring, is kept considerably low before the decompression cam 11 lies against the camshaft 4, but on the other side the push rod 12 is not lifted from the base circle 20 of the cam 21 during the usual operation of the engine. The constriction 24 on the decompression cam enlarges the place of contact between the camshaft 4 and the decompression cam and, therefore, reduces the wear on the two parts.

We claim:

1. An internal combustion engine which includes an automatically discontinuing decompression mechanism, the engine including an elongated camshaft which is rotated by the engine, the elongated camshaft including a shoulder part and a cam, the cam having an outer surface which in part is cylindrical in shape and in part lobe-shaped, the portion of the elongated camshaft extending from the side of the cam opposite the shoulder part defining a first (root) diameter and the portion of elongated camshaft extending between the cam and the shoulder part defining a second diameter which is smaller than the first (root) diameter, the shoulder including a bore which extends in parallel with the elongated camshaft, the bore being located from the axis of the camshaft a distance greater than half the first (root) diameter, a transmitting member movably extending between said cam and a valve associated with a combustion chamber, the rotation of said camshaft causing the cam to move said transmitting member such that the valve to which said transmitting member is connected will open and close;

a rotatable, elongated decompression element, the elongated decompression element including a control shaft, a ratchet wheel which is interconnected with the control shaft, the ratchet wheel including a number of teeth and a circumferential portion which is tooth free, and a decompression cam which is interconnected with the ratchet wheel, the decompression cam including a portion which has an outer surface which in part is cylindrical in shape and in part is flat, this portion of the decompression cam being located between the shoulder and the cam such that when rotated in order that its flat outer surface part faces the transmitting member, no contact therewith is made, but when rotated in order that its cylindrical outer surface part faces the transmitting member, contact therewith is made and the transmitting member is prevented from contacting the cylindrical outer surface part of the cam such that the associated valve is prevented from closing the associated combustion chamber, and a shifting member located in the bore in the shoulder part of the elongated camshaft, the shifting member including a projecting portion which extends outwardly of the shoulder part to a point adjacent the ratchet wheel of the rotatable, elongated decompression element, the shifting member when rotated by the camshaft not contacting the ratchet wheel when the circumferential tooth-free portion of the ratchet wheel is opposite the projecting portion of the shifting member but otherwise contacting the teeth of the ratchet wheel to incrementally rotate the ratchet wheel and thus the decompression element as a whole with each revolution of the camshaft.

2. The internal combustion engine as defined in claim 1, wherein the decompression element is constructed such that when the circumferential tooth-free portion of the ratchet wheel is opposite the projecting portion of the shifting member, the flat outer surface of the decompression cam faces the transmitting member.

3. The internal combustion engine as defined in claim 2, wherein the control shaft of the decompression element extends through a bearing sleeve mounted in a side wall of the internal combustion engine, and wherein the end of the control shaft opposite the end connected to the ratchet wheel includes a manually operable handle fixedly attached thereto.

4. The internal combustion engine as defined in claim 3 wherein the handle includes a recess on the side thereof facing the bearing sleeve; wherein the bearing sleeve includes a blind bore which faces the handle; and wherein a spring and a ball are located in the bore in the bearing sleeve, the spring forcing the ball toward the handle to lock in the recess therein with each revolution of the decompression element.

5. An improved internal combustion engine having a camshaft with at least one cam having a base circle and a lobe elevated therefrom; a valve acting in association with a combustion chamber; a transmitting member, transmitting the lift of said cam to said valve a rotatable decompression device, said rotatable decompression device comprising a control shaft, a ratchet wheel connected to said control shaft, and a decompression cam connected to said ratchet wheel; and a shifting member interacting with said ratchet wheel for resetting said decompression cam; wherein said decompression cam is arranged between said transmitting member and a cam-free part of said camshaft, and said shifting member is arranged eccentrically to said camshaft and at a distance to the axis of said camshaft of greater than half the root diameter thereof.

6. The improved internal combustion engine of claim 5 wherein said shifting member includes a spring-loaded pin which is arranged in a bore in a shoulder of said camshaft.

7. The improved internal combustion engine of claim 5 wherein said control shaft carrying said decompression cam is pivoted in an eccentric bearing sleeve.

8. The improved internal combustion engine of claim 5 additionally comprising a locking device to lock a position of said control shaft at which said decompression cam is not in operation.

9. The improved internal combustion engine of claim 8 wherein said locking device includes a spring-loaded ball and a cavity into which said ball can snap.

10. The improved internal combustion engine of claim 5 wherein said decompression cam is supported by said cam-free part of said camshaft during the decompression action.

11. The improved internal combustion engine of claim 10 wherein said cam-free part has a smaller diameter thna the root diameter of said camshaft.

12. The improved internal combustion engine of claim 11 wherein said decompression cam is shaped to include a constriction in the region supported during the decompression action, which is in conformity with the surface of said camshaft in this region.

* * * * *